United States Patent [19]

Trueb

[11] 3,960,274

[45] June 1, 1976

[54] WALL-MOUNTED LAUNDRY DRIERS

[75] Inventor: Victor Trueb, Oberhelfenschwil, Switzerland

[73] Assignee: Heinz Hermann Weick, Geneva, Switzerland

[22] Filed: July 9, 1973

[21] Appl. No.: 377,834

[30] Foreign Application Priority Data

July 8, 1972 Switzerland ..... 10331/72

[52] U.S. Cl. ..... 211/1.3; 211/96

[51] Int. Cl.[2] ..... A47B 53/00

[58] Field of Search ..... 211/97, 1.3, 87, 119.06, 211/96, 104, 168; 248/278; 403/57; 220/37, 34; 217/83

[56] References Cited

UNITED STATES PATENTS

| | | | |
|---|---|---|---|
| 237,073 | 1/1881 | Wing | 211/96 X |
| 348,882 | 9/1886 | Bolton | 211/104 |
| 372,883 | 11/1887 | Weis | 248/278 X |
| 823,807 | 6/1906 | Peters | 211/96 |
| 1,309,348 | 7/1919 | Boye | 211/96 X |
| 2,084,584 | 6/1937 | Jacobs | 248/278 X |
| 2,562,836 | 7/1951 | Veschio | 211/96 |
| 2,745,202 | 5/1956 | Wood | 160/220 X |
| 2,917,186 | 12/1959 | Beets | 211/97 |
| 3,350,856 | 11/1967 | Revell | 211/96 X |
| 3,606,018 | 9/1971 | Ruiha | 211/104 X |

FOREIGN PATENTS OR APPLICATIONS

| | | | |
|---|---|---|---|
| 656,875 | 1/1929 | France | 211/96 |
| 729,515 | 12/1966 | Italy | 211/1.3 |
| 569,794 | 11/1957 | Italy | 211/1.3 |

*Primary Examiner*—James C. Mitchell
*Attorney, Agent, or Firm*—Ladas, Parry, Von Gehr, Goldsmith & Deschamps

[57] ABSTRACT

The invention provides a wall mounted laundry drier having an elongated housing of open trough configuration arranged to be mounted on a wall with the trough open upwards. Two support arms are provided mounted in articulated fashion, one at each end of the housing, for movement between a closed position where they form a cover for the housing trough, and an open position where they extend outwards from the housing and the wall. A plurality of rows of flexible line are arranged between the support arms to be taut when the arms are in the open position for the support of items of laundry, and to lie in the housing trough when the arms are in the closed position.

10 Claims, 10 Drawing Figures

FIG. 2
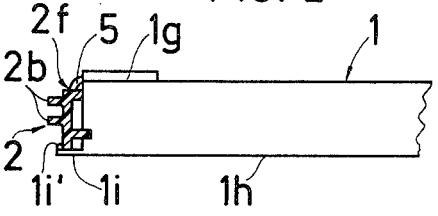
FIG. 3
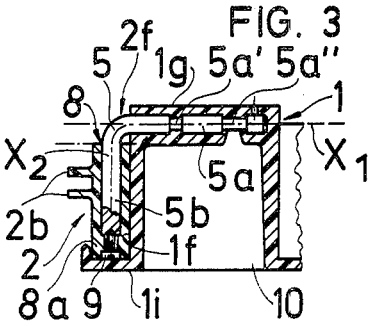
FIG. 4
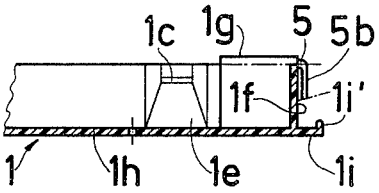
FIG. 5
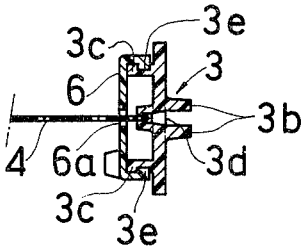
FIG. 6
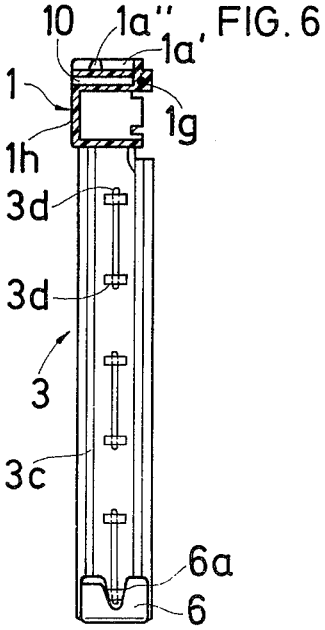
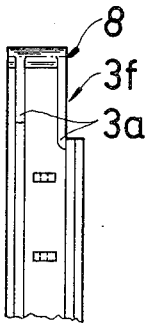
FIG. 7
FIG. 8
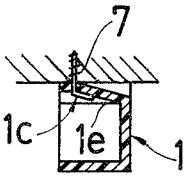

WALL-MOUNTED LAUNDRY DRIERS

BRIEF SUMMARY OF THE INVENTION

The present invention relates to a wall-mounted laundry drier of the type having a U-shaped cross-section housing for attachment to a wall and on the two ends of which, both these ends being closed by end walls, there are pivotably mounted two support arms strung across with a plurality of lines, the said support arms when inwardly pivoted, serving as half-covers to cover the open side of the U-shaped bar which houses the line, whereas, when the support arms are hinged outwardly, the lines are stretched taut between the arms and ready for use.

The disadvantage of such a laundry drier is that when the support arms are pivoted to close, the lines hang downwards and must be manipulated into the interior of the bar. An object of this invention is to overcome or mitigate this disadvantage.

The invention resides in the fact that each of the support arms is mounted to a respective end of the U-shaped bar by means of a hinge means arranged to provide pivotal movement between the arm and housing about a first axis which is longitudinal of the housing and about a second axis which is transverse to said first axis.

In consequence, it is possible to attach the housing against a wall in such a way that its open side is upwards so that the lines may fall into the housing without manual aid as the support arms are pivoted downwardly.

BRIEF DESCRIPTION OF THE DRAWINGS

An example of embodiment of the invention is illustrated in the attached drawings, in which:

FIG. 2 is a section on the line II—II in FIG. 1 when the left-hand support arm is in the working position;

FIG. 3 is a section on the line III—III in FIG. 1 when the left-hand support is in the working position;

FIG. 4 is a section on the line IV—IV in FIG. 1, the corresponding support arm being omitted;

FIG. 5 is a section on the line V—V through the right-hand support arm;

FIG. 6 is a section on the line VI—VI through the U-shaped bar with the inner lateral view of the right-hand support arm;

FIG. 7 is an inner lateral view on arrow VII of the rear zone of the right-hand support arm alone FIG. 8 is a section on the line VIII—VIII through the U-shaped bar and FIG. 9 is a perspective view of the laundry drier of FIG. 1.

DETAILED DESCRIPTION OF PREFERRED EMBODIMENT

Figure 1:
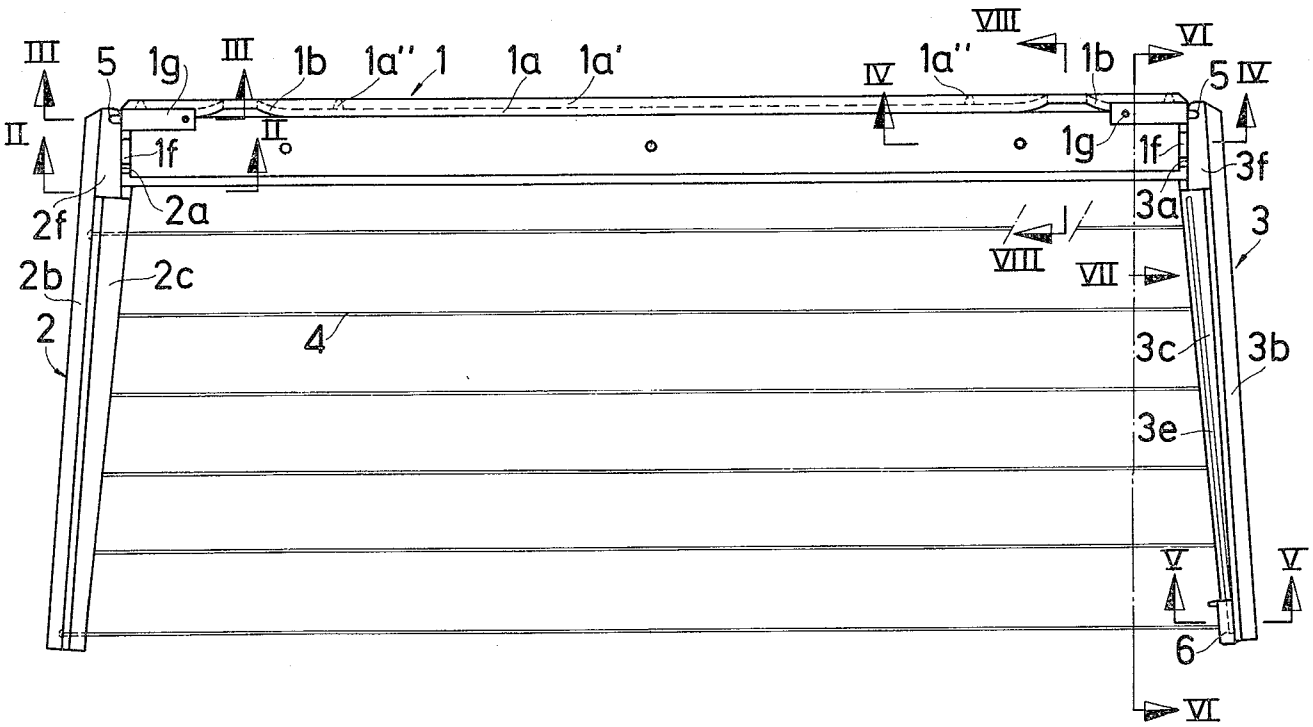
FIG. 1 is a plan view of the laundry drier when the support arms are in the working position.
Figure 9:
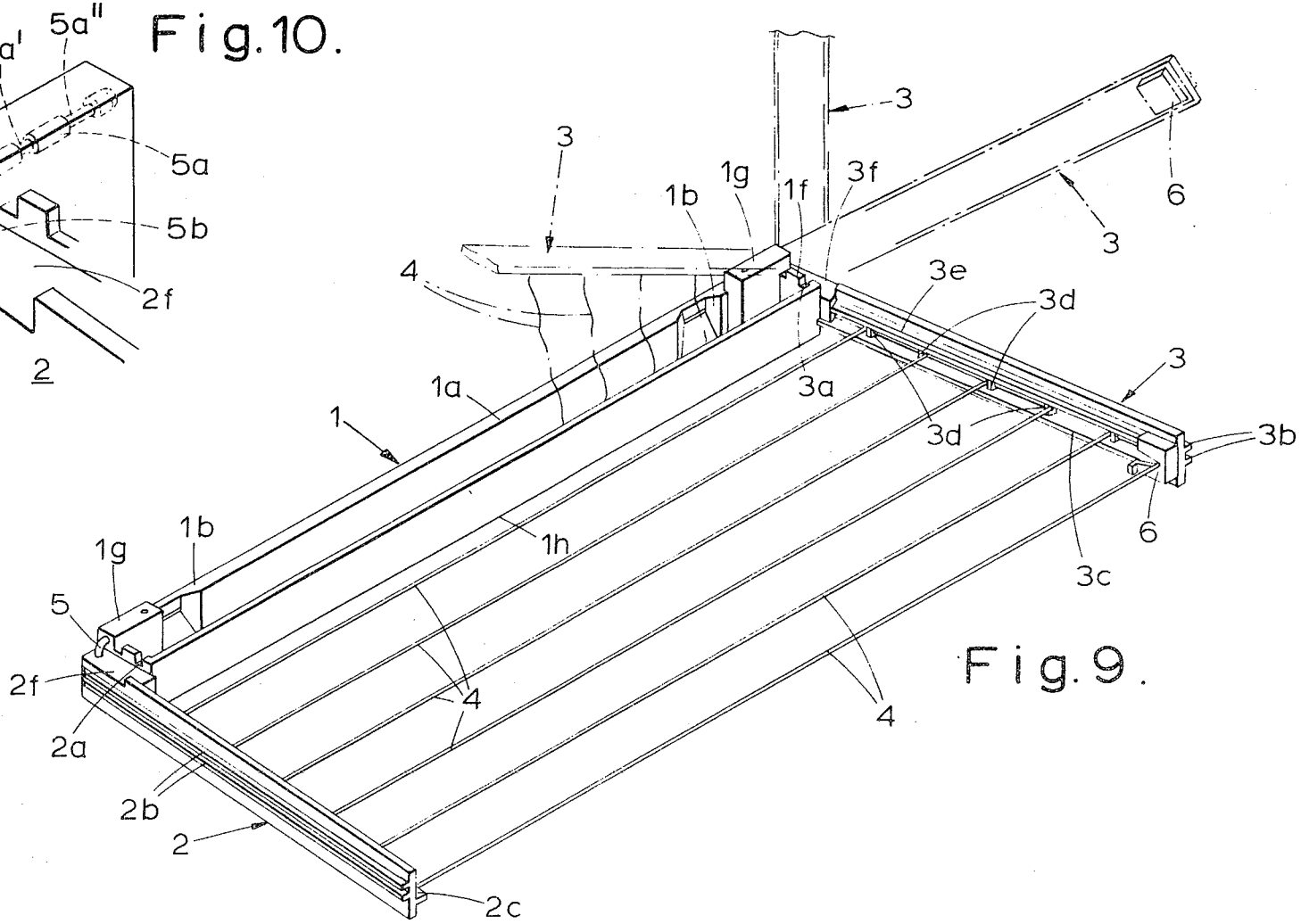
Figure 10:
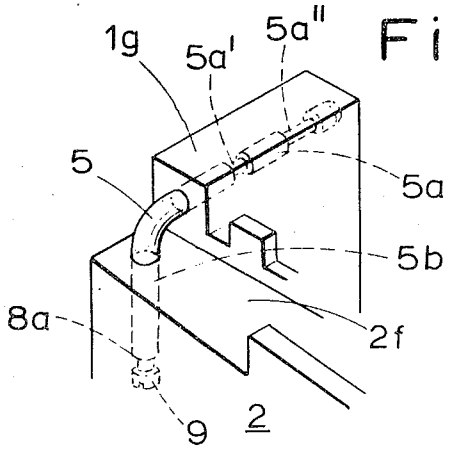
FIG. 10 is an enlarged perspective detail view of the drier shown in FIG. 9.

Essentially, the wall-mounted laundry drier consists of the U-shaped cross-section housing 1, two support arms 2,3, lines 4 stretched between the support arms, hinge means interconnecting the arms 2,3 and the housing 1, and a slide 6. The rear wall 1*a* of the housing 1 is provided at the top with a rearwardly projecting edge 1*a'* and at the bottom with spacer knobs 1*a''* dimensioned according to the width of the edge 1*a'*. Moreover, in recesses 1b directed towards the plane of abutment on the wall, there is in each case a slot-shaped elongated hole 1*c* extending in the longitudinal direction of the housing 1 and serving for wall mounting of the housing. Zones 1*e* of the wall below the elongated holes 1*c* extend conically outwardly from the bottom 1*h* of the housing 1 1*a*. Hooks 7 serve as fixing means. Independently of the laundry drier, these hooks are first screwed sufficiently far into plugs inserted into the wall that they project from the wall by an amount corresponding to the wall thickness of the housing 1. Once the hooks 7 have been positioned horizontally, the housing 1 is fitted onto them, whereupon the hooks 7 are rotated downwards, their bent-over portions encountering the inclined surfaces 1*e*, ensuring a rigid attachment of the laundry drier. The elongated holes 1*c* moreover provide for longitudinal tolerance for the positioning of the hooks 7, which simplifies installation.

Therefore, when the laundry drier is fitted, the open side of the housing 1 is directed upwardly. The two support arms 2,3 have their rear ends so attached to the end portions of the housing that, in a first position they serve as covers to mask the open side of the housing, and from that position they may be pivoted first upwardly and from thence forwards into a horizontal position. This double movement in two planes which are at right angles to each other necessitates the use of hinge means having two pivot axes aligned at right angles to each other. Each hinge means comprises a round bar 5 bent at a right angle to provide arms 5*a*, 5*b*. One arm 5*a* of each bar 5 lies in the plane of the open side of the housing 1, and is rotatably mounted on the rear wall 1*a* in the longitudinal direction of the bar, such that the other arm 5*b* extends somewhat outside of the corresponding end face 1f of the housing 1. This second arm 5*b* is rotatably mounted in a bore 8 in the rear part of the respective support arm 2,3 and aligned at right angles to the longitudinal direction thereof. The arms 5*a* are suitably mounted in the housing 1 during the manufacture thereof by a process of injection moulding, while the connection between the arms 5*b* and the support arms 2 and 3 is made subsequently. For axial positioning the arms 5*a* are provided with annular grooves 5*a''*, 5*a'*. In order that the adhesion which would initially exist between the arms 5*a* and the plastics material surrounding them is not so great that initial rotation presents difficulties, the aforesaid arms 5*a* may be coated for example with silicone prior to being laid in the mould for the housing. Axial positioning of the arms 5*b* is ensured by a reduced diameter portion 8*a* at the bottom of the bores 8 in conjunction with axial screws 9 engaging the ends of the arms 5*b*.

Below the attachment zones 1*g* for the arms 5*a* the corresponding wall 1*a* of the housing 1 is hollow from beneath in that in each case a narrow chamber 10 is integrally formed, so avoiding undesirably prolonged stoppage times during injection moulding of the housing 1.

So that the support arms 2,3, as they are pivoted downwardly, cannot move beyond the horizontal working position, angular stops 1*i* which project outwards beyond the end faces 1*f* are provided on the housing 1 as an extension of its bottom 1*h*, the outer webs 1*i'* of the stops forming useful lateral abutments for the support arms 2,3.

FIG. 1 further shows that the inner surfaces 2*a*, 3*a* of the rear parts of support arms 2, 3 which, in the working position of the said support arms, rest against the outside surfaces of the end walls 1*f* of the housing 1, are orientated slightly obliquely with respect to the longitudinal direction of the support arms. Consequently, the two support arms 2, 3 when pivoted into the horizontal working position, do not extend parallel but diverge slightly outwards from the housing 1. In consequence, the support arms 2, 3 when subject to considerable inward force when the lines 4 carry a load, do not bend inwards beyond a right-angle with respect to the longitudinal direction of the housing 1, that is to say beyond their parallel state which would give an unaesthetic appearance.

To stabilise the support arms 2, 3 they are provided externally with closely mutually adjacent longitudinal webs 2*b*, 3*b* and internally with more remotely disposed rearwardly widening longitudinal webs 2*c*, 3*c*. Provided between the outer webs 2*b*, 3*b* are a series of line apertures 3*d*, while the inner longitudinal webs 3*c* of the support arm 3 have a guide groove 3*e* on each of the turned-away faces. Mounted in the guide grooves is a U-shaped slide member 6, the web of which is provided with a slot-like recess 6*a* open towards the bearing zone of the support arm 3, for holding the line 4.

The rear end preferably of the lower longitudinal webs 3*c* can be used as a stop, in that in the horizontal working position of the support arms 2, 3, it bears against the front wall of the housing 1. If such an arrangement is used, it is possible to dispense with the stops 1*i*.

Both support arms 2, 3 are also provided in their rear end zones on the side on which the arms 5b enter, with recesses 2*f*, 3*f* corresponding to the length and width of the attachment zones 1g over the open side of the housing 1, and in which there is thus space for the attachment zones 1g when the support arms 2, 3 are resting on the open face of the housing 1.

The laundry drier is very simple to use. In the closed inwardly pivoted state, the two support arms 2, 3 lie over the open side of the housing 1, in which the lines 4 lie. In order to use the laundry drier, the two support arms 2, 3 are first pivoted upwardly and from thence forwardly into their horizontal working position, the lines 4 automatically becoming stretched taut. After use, the two support arms 2, 3 are pivoted upwardly again. The support arm 2 is then lowered to rest as a cover on the housing 1. The slide member 6 is then moved rearwards as far as the bearing zone, which lowers the line 4 towards the interior of the housing, while at the same time the support arm 3 is pivoted anticlockwise until this, too, rests as a cover on the housing 1. As a result of the lines 4 being deflected by the slide member 6, the lines 4 are easily introduced into the housing 1. It is possible to dispense with the slide member 6, particularly in the case of very flexible lines, since the lines will easily drop into the housing 1 without additional help.

Also, other forms of hinge means having orthogonal pivot axes may be used. For example, the support arms may be transversely divided by a hinged joint, the rear parts of the support arms being attached in the centre of the end walls of the housing 1 by means of bearing spindles extending in the longitudinal direction of the housing. The hinge pins of the hinges between the parts of the support arms would, when the support arms are pivoted upwards or are pivoted into the closed position, need to lie approximately in the plane of the open side of the housing. Moreover, the housing, at least in its end zones (as measured from the bearing axes of the end faces) would need to be more forwardly projecting than upwardly in order thereby to provide an inner abutment for the front, longer zones of the support arms in the outwardly pivoted horizontal working position.

I claim:

1. A laundry drier for mounting on a vertical wall comprising: an elongated housing of U-shaped cross-section having an end wall at each end to leave an open face and means for attaching the housing to said vertical wall with said open face upwards, two support arms mounted by hinge means one at each end of said housing and movable between a closed position each to form a half cover for said open face of the housing, and an open position to extend outwardly from the respective end of the housing in a plane generally parallel with said open face of the housing, and a plurality of rows of flexible line extending between respective spaced points on said support arms to be taut and parallel when said arms are in said open position and to lie within said housing when said arms are in said closed position, said hinge means being arranged to provide pivotal movement between the respective arm and said housing about a first axis which is longitudinal of said housing and about a second axis which is transverse to said first axis.

2. A laundry drier according to claim 1, wherein said hinge means each comprise a hinge pin formed as two arms by bending a round bar through a right angle, one arm being pivotally mounted in said housing about an axis longitudinal of the housing and adjacent the plane of said open face, and the other arm being pivotally mounted in the respective support arm with its axis transverse of that arm.

3. A laundry drier according to claim 2, wherein said housing is provided at each end with a bearing housing to receive said one arm of the respective hinge pin, and said support arms are each formed with a recess to accomodate said bearing housing when they are in said closed position.

4. A laundry drier according to claim 2, wherein said housing is formed as a synthetic plastics material moulding, and said one arm of the hinge pin is formed with an annular retaining groove, the one arm being mounted in the housing during the moulding thereof.

5. A laundry drier according to claim 2, wherein said support arms are each provided with a transverse shouldered bore to receive said other arm of the respective hinge pin, and an axial screw is provided threaded into the end of said other arm to retain said other arm in the associated transverse bore.

6. A laundry drier according to claim 1, wherein the inner surfaces of said support arms abut the other surfaces of said end walls of the housing when said arms are in their open position whereby to resist the tension of said rows of line between the arms.

7. A laundry drier according to claim 1, wherein projections are provided on each end wall of said housing to engage the respective support arm when it is in its open position, to prevent movement of the support arm about said first axis beyond said plane generally parallel with said open face of the housing.

8. A laundry drier according to claim 1, wherein said support arms are divergent outwardly from said housing when in said open position.

9. A laundry drier according to claim 1, wherein said support arms are each provided with an inwardly facing abutment positioned to engage the front wall of said housing when said arms are in their open position.

10. A laundry drier according to claim 1, wherein said means for mounting the housing on a wall are positioned at each end of the housing adjacent said hinge means.

* * * * *